US011542843B2

(12) United States Patent
Liu

(10) Patent No.: US 11,542,843 B2
(45) Date of Patent: Jan. 3, 2023

(54) INSERTION PIECE FOR CAMSHAFT PHASER AND CAMSHAFT PHASER

(71) Applicant: Schaeffler Technologies AG & Co. KG, Herzogenaurach (DE)

(72) Inventor: Xiaona Liu, Shanghai (CN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 5 days.

(21) Appl. No.: 17/275,829

(22) PCT Filed: Sep. 25, 2018

(86) PCT No.: PCT/CN2018/107304
§ 371 (c)(1),
(2) Date: Mar. 12, 2021

(87) PCT Pub. No.: WO2020/061739
PCT Pub. Date: Apr. 2, 2020

(65) Prior Publication Data

US 2022/0042427 A1 Feb. 10, 2022

(51) Int. Cl.
*F01L 1/344* (2006.01)

(52) U.S. Cl.
CPC ... *F01L 1/3442* (2013.01); *F01L 2001/34433* (2013.01); *F01L 2001/34483* (2013.01)

(58) Field of Classification Search
CPC ..... F01L 1/3442; F01L 2001/34433; F01L 2001/34483; F01L 2001/34469; F01L 2250/02; F01L 2001/34426; F01L 2001/3443
USPC ..... 123/90.17
See application file for complete search history.

(56) References Cited

U.S. PATENT DOCUMENTS

| | | | |
|---|---|---|---|
| 5,040,651 | A | 8/1991 | Hampton et al. |
| 5,727,508 | A | 3/1998 | Goppelt |
| 2003/0051686 | A1 | 3/2003 | Trappe et al. |
| 2012/0152188 | A1 | 6/2012 | Weber et al. |
| 2013/0055978 | A1 | 3/2013 | Weißer |
| 2014/0123920 | A1 | 5/2014 | Lichti et al. |
| 2015/0211391 | A1 | 7/2015 | Bayrakdar |
| 2017/0248045 | A1 | 8/2017 | Pritchard et al. |

(Continued)

FOREIGN PATENT DOCUMENTS

| | | | |
|---|---|---|---|
| CN | 102071983 | A | 5/2011 |
| CN | 102149901 | A | 8/2011 |
| CN | 103016090 | A | 4/2013 |

(Continued)

*Primary Examiner* — Jorge L Leon, Jr.

(57) ABSTRACT

The present disclosure relates to an insertion piece for a camshaft phaser and the camshaft phaser. The insertion piece is configured to be partially inserted and mounted into a center hole of the rotor of the camshaft phaser. The insertion piece has a stepped cylindrical shape across its entirety and includes a first cylinder portion, a second cylinder portion, and a third cylinder portion, which are connected to each other and are coaxially arranged. The first cylinder portion extends along the axial direction; the second cylinder portion is located at one axial side of the first cylinder portion and extends along the axial direction; the third cylinder portion is located at one axial side of the second cylinder portion and extends along the axial direction; and a clamping connection portion for fixing the coil spring of the camshaft phaser is formed on the third cylinder portion.

20 Claims, 6 Drawing Sheets

(56) References Cited

U.S. PATENT DOCUMENTS

2018/0058272 A1 3/2018 Haltiner, Jr.

FOREIGN PATENT DOCUMENTS

| | | | |
|---|---|---|---|
| CN | 103375215 | | 10/2013 |
| CN | 104420919 | A | 3/2015 |
| CN | 105386879 | A | 3/2016 |
| CN | 105793527 | A | 7/2016 |
| CN | 205532749 | U | 8/2016 |
| CN | 107002518 | | 8/2017 |
| CN | 107091129 | A | 8/2017 |
| CN | 107916963 | A | 4/2018 |
| CN | 107939468 | A | 4/2018 |
| CN | 108301890 | A | 7/2018 |
| EP | 0717171 | A1 | 6/1996 |
| EP | 2690261 | B1 | 9/2016 |
| GB | 2423565 | A | 8/2006 |
| WO | 2008015062 | A2 | 2/2008 |
| WO | 2014056490 | A1 | 4/2014 |

INSERTION PIECE FOR CAMSHAFT PHASER AND CAMSHAFT PHASER

CROSS-REFERENCE TO RELATED APPLICATIONS

This application is the U.S. National Phase of PCT Application No. PCT/CN2018/107304 filed on Sep. 25, 2018, the entire disclosure of which is incorporated by reference herein.

TECHNICAL FIELD

The present disclosure relates to an insertion piece for a camshaft phaser and the camshaft phaser.

BACKGROUND

A variable valve timing system is an important part for ensuring engine performance. Such a system can adjust the opening and closing of an engine valve as required so that the engine can reach an expected power output and have other properties. The variable valve timing system includes a camshaft phaser assembled together with a camshaft.

As shown in FIG. 1*a*, the camshaft phaser in the prior art includes a stator (not shown), a rotor 10, an end cover 20, a spring cover 30, a coil spring 40, a fixing pin 50, and an outer cover 60.

Specifically, the stator includes a cylindrical stator body and several stator protrusions protruding towards the inner radial side from the stator body.

As shown in FIG. 1*b*, the rotor 10 is arranged on the inner radial side of the stator and can rotate relative to the stator. The rotor 10 includes a cylindrical rotor body 101 and several rotor blades 102 protruding towards the outer radial side of the rotor body 101. The plurality of rotor blades 102 and the plurality of stator protrusions are alternately arranged circumferentially, so that each rotor blade 102 is located between two adjacent stator protrusions. In this way, a space between the adjacent two stator protrusions is divided into two mutually independent oil chambers by the rotor blade 102 located between the two stator protrusions.

A center hole 101*h* for mounting the central valve and a camshaft is formed in the rotor body 101. The center hole 101*h* runs through the rotor body 101 axially A, and as shown in FIG. 1*c*, the center hole 101*h* has a stepped structure formed by a first hole wall portion 101*h*1, a second hole wall portion 101*h*2, a third hole wall portion 101*h*3, and a fourth hole wall portion 101*h*4. As shown in FIG. 1*b* and FIG. 1*c*, the first hole wall portion 101*h*1 and the second hole wall portion 101*h*2, which have the same inner diameter, of the center hole 101*h* are formed by turning and spinning processing of a green body; and the third hole wall portion 101*h*3 protruding towards the inner radial side relative to the first hole wall portion 101*h*1 and the second hole wall portion 101*h*2 and the fourth hole wall portion 101*h*4 sunken towards the outer radial side of the first hole wall portion 101*h*1, and the second hole wall portion 101*h*2 of the center hole 101*h* are formed by hard turning processing.

The end cover 20 and the spring cover 30 are fixed on the stator from the two axial sides through fixing components so that the end cover 20 and the spring cover 30, together with the stator and the rotor 10, form the surrounding structure of the oil chambers. The coil spring 40 is fixed on the end cover 20; moreover, one end of the coil spring 40 is fixed on the end cover 20 and the other end of the coil spring 40 is fixed and mounted on the fixing pin 50 of the rotor body 101. The outer cover 60 slides over the stator from one axial side and is configured to fit together with the central valve.

Research by the inventor found that the camshaft phaser with the above structure has the following problems:

1. Since the stepped structure of the center hole 101*h* of the rotor body 101 of the rotor 10 needs to be formed by turning and spinning processing of the green body and hard turning processing, the rotor 10 is expensive, and since the center hole 101*h* is configured to be directly assembled on the central valve and the camshaft, the rotor 10 has a large axial width;
2. The fixing pin 50 is mounted (fixed) on the rotor body 101 so that the other end of the coil spring 40 is fixed on the fixing pin 50, but the fixing pin 50 protrudes toward one axial side of the rotor body 101 much more than the rotor body 101 and is provided with a head, so mounting the fixing pin 50 requires a large space, and there may be interference between the fixing pin 50 and other parts; and
3. The fixing pin 50 is configured to fix the spring, resulting in a complex structure and greater expense for the rotor 10.

SUMMARY

The present disclosure has been made in view of the deficiencies of the prior art as described above. An object of the present disclosure is to provide an insertion piece for the camshaft phaser. The insertion piece enables the center hole of the rotor to form a stepped structure without requiring the two kinds of aforementioned processing, and the insertion piece can replace the fixing pin of the camshaft phase in the prior art, thereby simplifying the structure of the rotor and reducing its cost.

Another object of the present disclosure is to provide a camshaft phaser that includes the insertion piece for the camshaft phaser.

To achieve the above objects, the following technical schemes are adopted.

The present disclosure provides an insertion piece for a camshaft phaser. The insertion piece for the camshaft phaser is configured to be partially inserted and mounted in the center hole of the rotor of the camshaft phaser. The insertion piece for the camshaft phaser has a stepped cylindrical shape across its entirety and includes a first cylinder portion, a second cylinder portion, and a third cylinder portion, which are connected to each other and are coaxially arranged. The first cylinder portion extends along an axial direction; the second cylinder portion is located at one axial side of the first cylinder portion and extends along the axial direction; the third cylinder portion is located at one axial side of the second cylinder portion and extends along the axial direction; and a clamping connection portion for fixing the coil spring of the camshaft phaser is formed on the third cylinder portion. Furthermore, the outer diameter of the first cylinder portion is less than the outer diameter of the second cylinder portion, and the outer diameter of the second cylinder portion is less than the outer diameter of the third cylinder portion.

The insertion piece for the camshaft phaser can further include a first connection portion and a second connection portion, wherein the first connection portion extends toward the outer radial side from the end edge of one axial side of the first cylinder portion; the end edge of the outer radial side of the first connection portion is connected to the second cylinder portion; the second connection portion extends toward the outer radial side from the end edge of one axial side of the second cylinder portion; and the end edge of the outer radial side of the second connection portion is connected to the third cylinder portion.

Each cylinder portion and each connection portion of the insertion piece for the camshaft phaser can be integrally formed.

The third cylinder portion can extend across part of the circumference along the circumferential direction, and the clamping connection portion is formed on the circumferential end part of the third cylinder portion.

The length of the third cylinder portion extending along the circumferential direction can be equal to or greater than half the circumference.

The clamping connection portion can include a gap formed on the circumferential end part of the third cylinder portion and a hook portion folded back toward the inner radial side from a bottom side forming the gap.

Several through-holes penetrating through the second cylinder portion along a radial direction and distributed in the circumferential direction are formed on the second cylinder portion.

The present disclosure further provides a camshaft phaser as follows. The camshaft phaser includes a stator and a rotor that is located on the inner radial side of the stator and can rotate relative to the stator, a center hole running through the rotor in the axial direction being formed in the rotor, and the insertion piece for the camshaft phaser according to any one of the aforementioned technical schemes, where the insertion piece for the camshaft phaser is fixed on the rotor, the first cylinder portion, the first connection portion, and the second cylinder portion of the insertion piece for the camshaft phaser are inserted into the center hole, and the second connection portion abuts against the end face on one axial side of the rotor.

The outer diameter of the second cylinder portion can be greater than the diameter of the center hole so that the second cylinder portion is mounted in the center hole in a manner of interference fit with the rotor.

The interior of the insertion piece for the camshaft phaser can be used to insert and mount the central valve; the central valve is cylindrical across its entirety and includes a central valve cylinder portion extending along the axial direction and a flange portion extending toward the outer radial side from the central valve cylinder portion; the central valve cylinder portion is inserted into the first cylinder portion and is in clearance fit with the first cylinder portion, and the flange portion abuts against the surface of one axial side of the second connection portion.

The camshaft phaser can further include a spring cover and a coil spring, wherein the spring cover is fixed on the stator from one axial side, and the third cylinder portion is located on the inner radial side of the spring cover; and the coil spring is mounted on the end face of one axial side of the spring cover and is supported by the third cylinder portion from the inner radial side; one end of the coil spring is fixed on the spring cover, and the other end of the coil spring is fixed on the clamping connection portion of the insertion piece for the camshaft phaser.

Multiple groups of oil chambers distributed along the circumferential direction can be formed between the rotor and the stator; each group of oil chambers includes a first oil chamber and a second oil chamber that are adjacent to one another; the first oil path connected to the first oil chamber and the second oil path connected to the second oil chamber are formed on the interior of the rotor; the first opening of each of the first oil paths at the center hole of the rotor does not overlap with the second opening of each of the second oil paths at the center hole of the rotor; and the through-holes formed in the second cylinder portion are opposite to the second openings respectively. The first cylinder portion is located between the first opening and the second opening in the axial direction.

By adoption of the above technical schemes, the present disclosure provides an insertion piece for a camshaft phaser and includes the camshaft phaser that uses such the insertion piece for the camshaft phaser. On the one hand, the insertion piece for the camshaft phaser is mounted in the center hole of the rotor and has a stepped cylindrical shape across its entirety. The central valve and the camshaft can be mounted at the insertion piece so that it is unnecessary for the center hole of the rotor to form a stepped structure; on the other hand, the insertion piece for the camshaft phaser is provided with a clamping connection portion for fixing the coil spring so that the insertion piece can replace the fixing pin of the camshaft phaser in the prior art. In this way, compared with the camshaft phaser in the prior art, the camshaft phaser according to the present disclosure has a simpler structure and lower cost.

DETAILED DESCRIPTION OF EMBODIMENTS

Specific embodiments of the present disclosure are described below with reference to the drawings of the description. In the present disclosure, unless otherwise specified, the axial direction, the radial direction, and the circumferential direction of the present disclosure refer to the axial direction, the radial direction, and the circumferential direction of the camshaft phaser (the insertion piece for the camshaft phaser). "One axial side" refers to the right side in FIG. 2*b*, and "the other axial side" refers to the left side in FIG. 2*b*.

The structure of the insertion piece for the camshaft phaser according to the present disclosure is described below in detail with reference to the accompanying drawings of the description.

(The Structure of the Insertion Piece for the Camshaft Phaser According to the Present Disclosure.)

The insertion piece for the camshaft phaser according to the present disclosure is configured to be partially inserted into the center hole of the rotor of the camshaft phaser and mounted on the rotor.

Figure 2A:
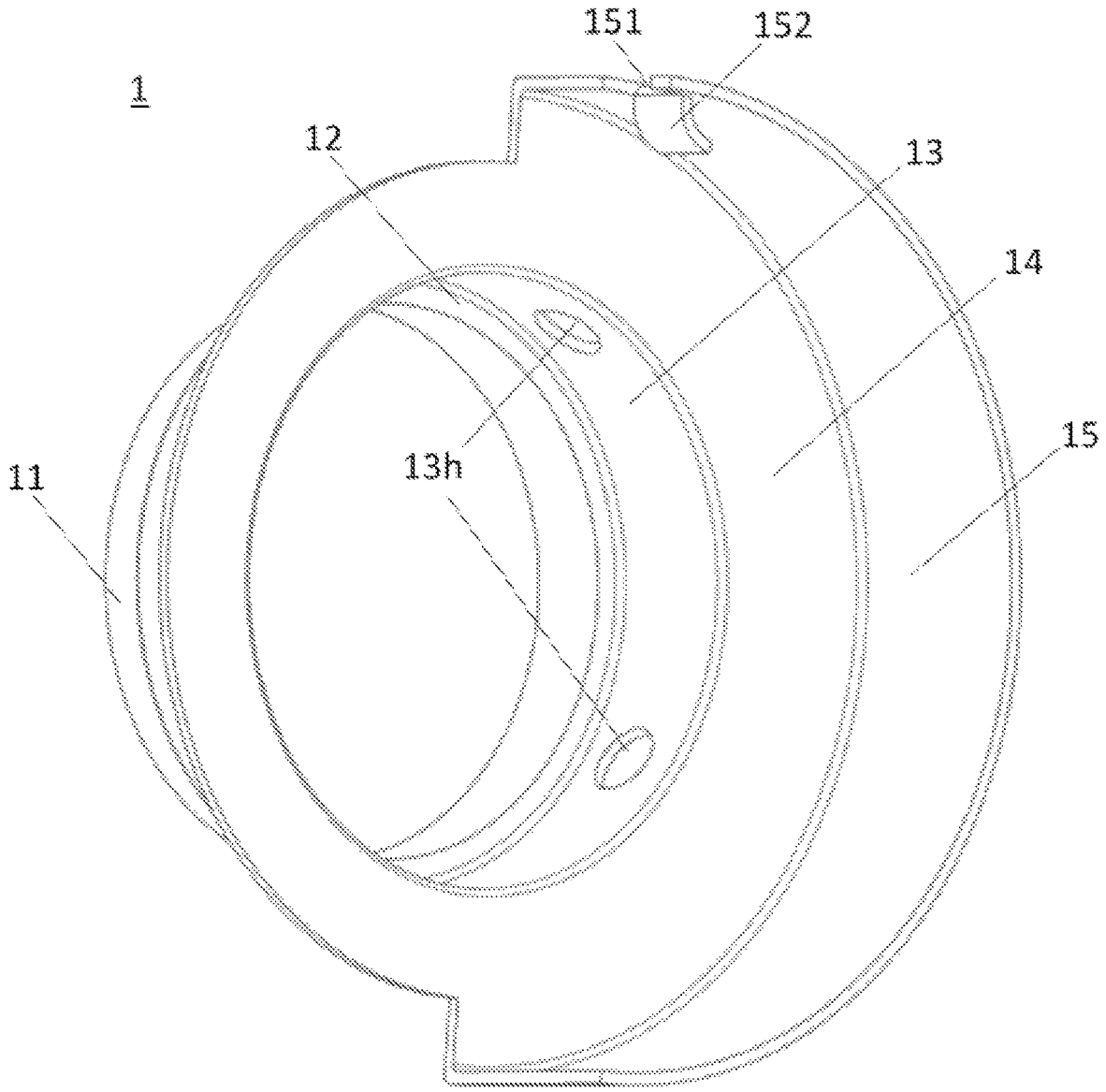
FIG. 2*a* is a three-dimensional structural schematic diagram of an insertion piece for a camshaft phaser according to the present disclosure.
Figure 2B:
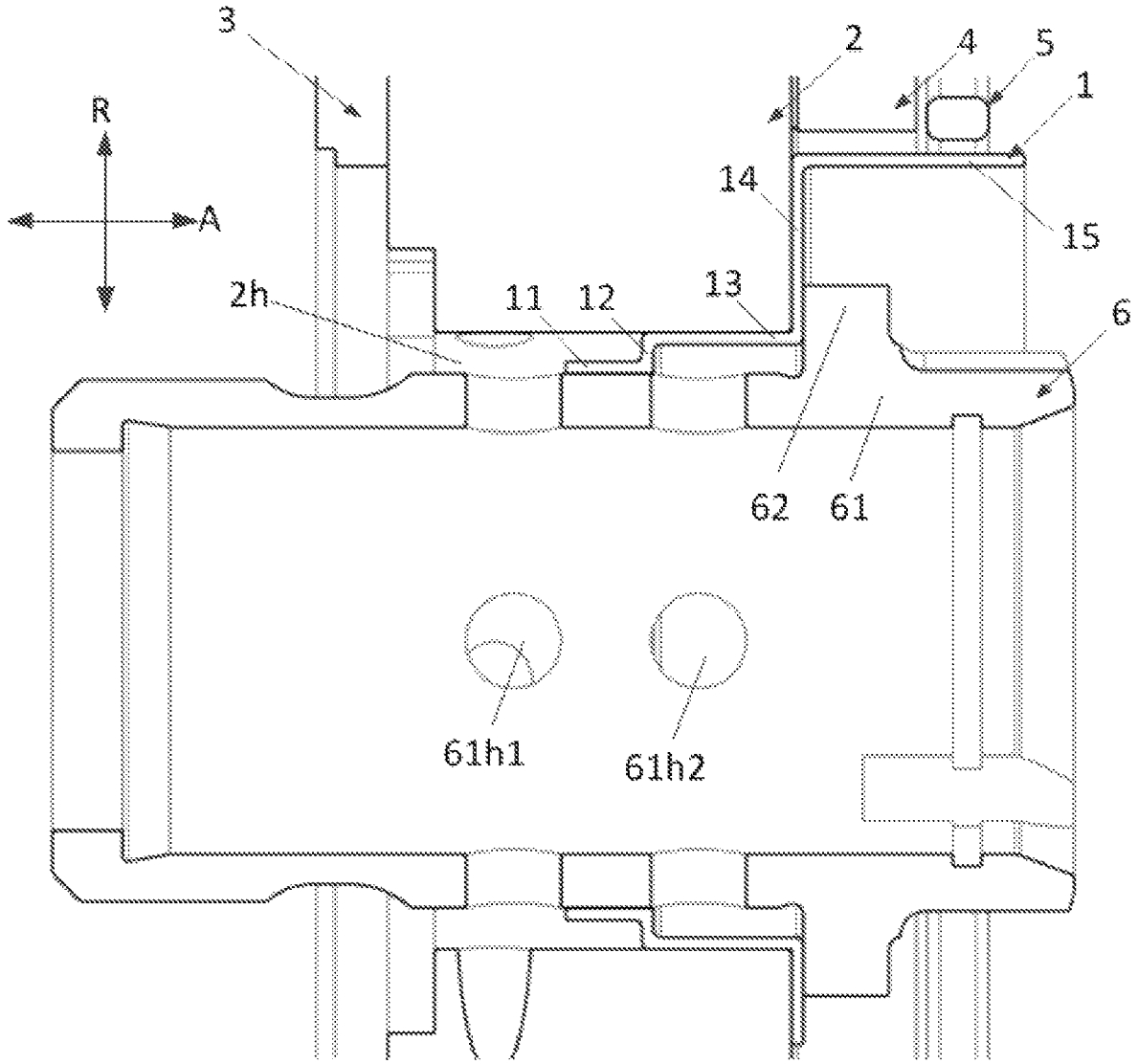
FIG. 2*b* is a sectional schematic diagram of an insertion piece for the camshaft phaser in FIG. 2*a*.

As shown in FIG. 2*a* and FIG. 2*b*, the peripheral wall of the insertion piece 1 for the camshaft phaser is bent several times so that the insertion piece 1 forms a stepped cylindrical shape across its entirety. The insertion piece 1 includes a first cylinder portion 11, a first connection portion 12, a second cylinder portion 13, a second connection portion 14, and a third cylinder portion 15, wherein the first cylinder portion 11, the second cylinder portion 13, and the third cylinder portion 15 are arranged coaxially.

Specifically, the first cylinder portion 11 continuously extends across the whole circumference along the circumferential direction and extends a predetermined length along the axial direction A.

The first connection portion 12 extends toward the outer radial side along the radial direction R from the end edge of one axial side of the first cylinder portion 11 so that the end edge of the inner radial side of the first connection portion 12 is connected to the end edge of one axial side of the first cylinder portion 11.

The second cylinder portion 13 is connected to the end edge of the outer radial side of the first connection portion 12 and extends a predetermined length toward one axial side along the axial direction so that the end edge of the other axial side of the second cylinder portion 13 is connected to the end edge of the outer radial side of the first connection portion 12. In this way, the outer diameter of the second cylinder portion 13 is greater than the outer diameter of the first cylinder portion 11. The second cylinder portion 13 continuously extends across the entire circumference along the circumferential direction.

In addition, in the embodiment, several through holes 13*h* that penetrate through the second cylinder portion 13 in the radial direction R and are distributed in the circumferential direction are formed in the second cylinder portion 13. The several through holes 13*h* are configured to correspond to oil paths formed in the rotor 2 of the camshaft phaser at openings of the center hole 2, which will be further described below.

The second connection portion 14 extends toward the outer radial side along the radial direction R from the end edge of one axial side of the second cylinder portion 13 so that the end edge of the inner radial side of the second connection portion 14 is connected to the end edge of one axial side of the second cylinder portion 13.

The third cylinder portion 15 is connected to the end edge of the outer radial side of the second connection portion 14 and extends a predetermined distance toward one axial side along the axial direction A so that the end edge of the other axial side of the third cylinder portion 15 is connected to the end edge of the outer radial side of the second connection portion 14. In this way, the outer diameter of the third cylinder portion 15 is greater than the outer diameter of the second cylinder portion 13.

In the embodiment, the third cylinder portion 15 extends on a part of the circumference along the circumferential direction, and the length of the third cylinder portion 15 extending along the circumferential direction is equal to half the circumference (that is, a central angle corresponding to a circumferential length of the third cylinder portion 15 is equal to 180 degrees). In this way, the third cylinder portion 15 has a length sufficient to support the coil spring 5 from the inner radial side without interfering with other parts.

Further, a clamping connection portion for fixing the coil spring 5 of the camshaft phaser is formed on the third cylinder portion 15. The clamping connection portion is formed on the circumferential end part of the third cylinder portion 15. The clamping connection portion includes a gap 151 formed at the circumferential end part of the third cylinder portion 15 and a hook portion 152 folded back toward the inner radial side from a bottom side forming the gap 151.

The cylinder portions 11, 13, and 15 and the connection portions 12 and 14 of the insertion piece for the camshaft phaser may be integrally formed by one-time formation.

The structure of the insertion piece 1 for the camshaft phaser according to the present disclosure is described above. The structure of the camshaft phaser including the insertion piece 1 will be described below in detail with reference to the accompanying drawings of the description.

(The Structure of the Camshaft Phaser According to the Present Disclosure.)

Figure 2C:
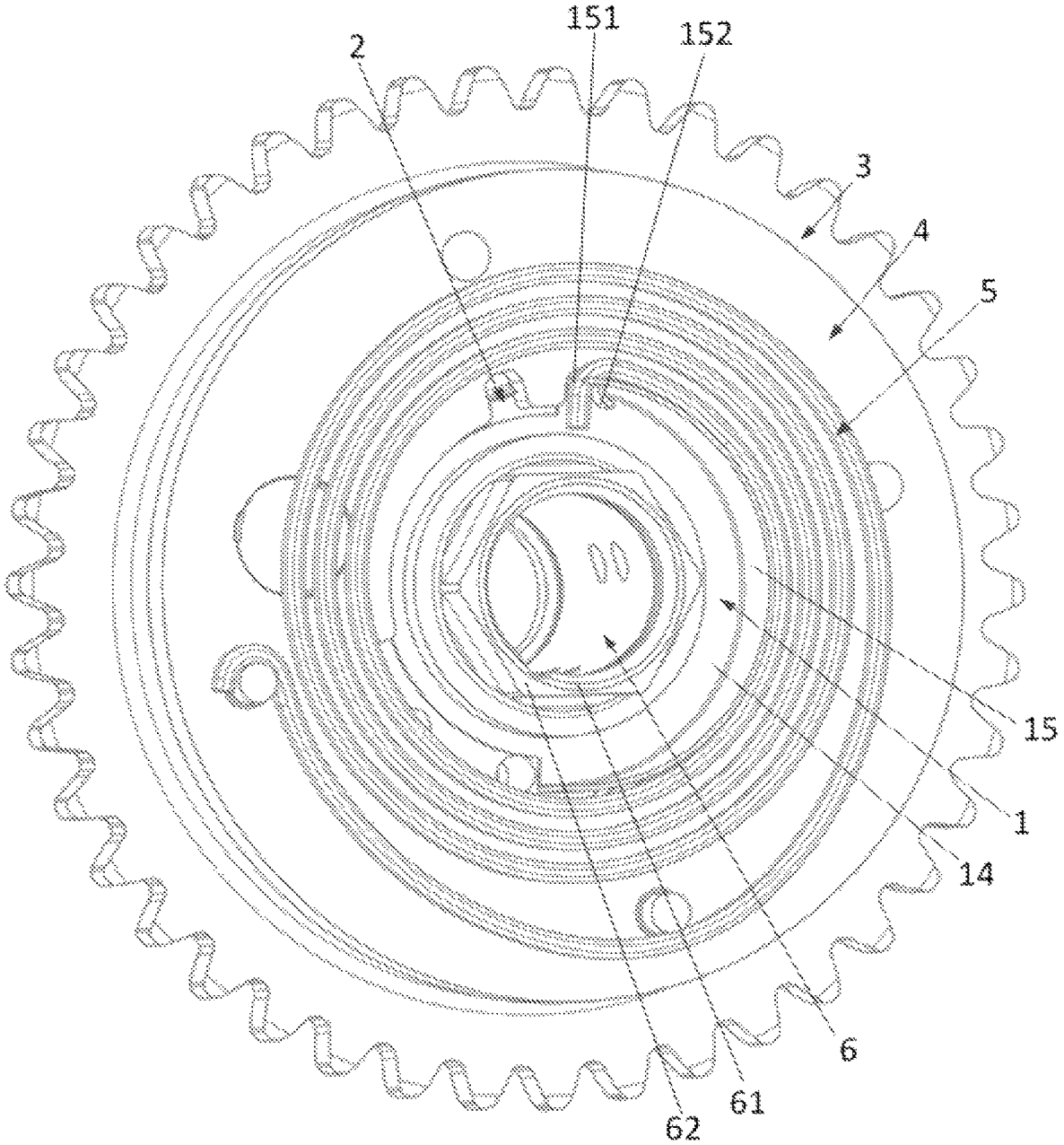
FIG. 2*c* is a three-dimensional schematic diagram of the camshaft phaser in FIG. 2*b*.

As shown in FIG. 2*b* and FIG. 2*c*, the camshaft phaser according to the present disclosure includes a stator (not shown), an insertion piece 1 for the camshaft phaser, a rotor 2, an end cover 3, a spring cover 4, and a coil spring 5.

Specifically, the stator includes a cylindrical stator body and several stator protrusions protruding towards the inner radial side from the stator body.

The rotor 2 is arranged on the inner radial side of the stator and can rotate relative to the stator. The rotor 2 includes a cylindrical rotor body and several rotor blades protruding towards the outer radial side of the rotor body. The plurality of rotor blades and the plurality of stator protrusions are alternately arranged circumferentially, so that each rotor blade is located between two adjacent stator protrusions. In this way, multiple groups of oil chambers are formed in the circumferential direction. Each group of oil chambers includes two mutually independent oil chambers (a first oil chamber and a second oil chamber), which are arranged between the adjacent two stator protrusions and are separated by the rotor blade between the two stator protrusions.

A center hole 2*h* running through the rotor body in the axial direction A is formed in the rotor body. The central axis of the center hole 2*h* is the same as the central axis of the rotor body, and the diameter of the center hole 2*h* is the same along the entire axial length. The first oil path connected to the first oil chamber and the second oil path connected to the second oil chamber are formed on the interior of the rotor. The first opening of each the first oil paths at the center hole 2*h* of the rotor body does not overlap with the second opening of each of the second oil paths at the center hole 2*h* of the rotor 2. Specifically, the first opening is located on the other axial side of the second opening. When the insertion piece 1 for the camshaft phaser is inserted and mounted at the center hole 2*h*, the second openings are opposite to the through holes 13*h* formed in the second cylinder portion 13.

The first cylinder portion 11, the first connection portion 12, and the second cylinder portion 13 of the insertion piece 1 for the camshaft phaser according to the present disclosure are inserted into the center hole 2*h*, and the second connection portion 14 abuts against the end face of one axial side of the rotor 2. Further, the outer diameter of the second cylinder portion 13 of the insertion piece 1 for the camshaft phaser is greater than the diameter of the center hole 2*h* of the rotor body so that the second cylinder portion 13 is mounted in the center hole 2*h* of the rotor body in a manner of interference fit with the rotor body so that the insertion piece 1 for the camshaft phaser is fixed on the rotor 2.

When the insertion piece 1 for the camshaft phaser is inserted and mounted in the center hole 2*h* of the rotor body, the first opening and the second opening formed at the center hole 2*h* of the rotor body are located on two axial sides of the first cylinder portion 11; that is, the first cylinder portion 11 is located between the first opening and the second opening in the axial direction A so that the central valve 6 can separate the first opening and the second opening through the connection between the first cylinder portion 11 and the first connection portion 12.

As shown in FIG. 2*b*, the central valve 6 is inserted and mounted in the insertion piece 1 for the camshaft phaser. The central valve 6 has a cylindrical shape across its entirety and includes a central valve cylinder portion 61 extending along the axial direction and a flange portion 62 extending toward the outer radial side from the central valve cylinder portion 61. The central valve cylinder portion 61 is inserted into the first cylinder portion 11, and the flange portion 62 abuts against the surface of one axial side of the second connection portion 14. The outer diameter of the central valve cylinder portion 61 is less than the inner diameter of the first cylinder portion 11 of the insertion piece 1 so that the central valve cylinder portion 61 and the insertion piece 1 form a clearance fit.

Two central valve through holes (the first central valve through hole 61*h*1 and the second central valve through hole 61*h*2) penetrating the central valve cylinder portion 61 along the radial direction R are formed in the peripheral wall of the central valve cylinder portion 61. The two central valve through holes are separated in the axial direction A. The first central valve through hole 61*h*1 corresponds to the first opening formed at the center hole 2*h* of the rotor body, and the second central valve through hole 61*h*2 corresponds to the second opening formed at the center hole 2*h* of the rotor body.

In addition, the central valve cylinder portion 61, for example, is mounted and fixed on the camshaft in a manner of threaded connection.

The spring cover 4 is fixed on the stator from one axial side, and the end cover 3 is fixed on the stator from the other axial side. The third cylinder portion 15 of the insertion piece 1 for the camshaft phaser is located in the inner radial side of the spring cover 4. The coil spring 5 is mounted on the end face of one axial side of the spring cover 4. The coil spring 5 is supported by the third cylinder portion 15 from the inner radial side (as shown in FIG. 2*c*). One end of the coil spring 5 is fixed at the protrusion formed on the spring cover 4, and the other end of the coil spring 5 is fixed at the gap 151 of the clamping connection portion of the insertion piece 1 for the camshaft phaser. In this way, as compared with the camshaft phaser in the prior art, the fixing pin for fixing the rotor 2 is omitted, and the coil spring 5 can still be prevented from being removed from the spring cover 4.

Although the specific technical solutions of the present disclosure have been described in detail in the specific embodiments, it should be noted that:

1. Although it has been described in the above specific embodiments that the length of the third cylinder portion 15 extending along the circumferential direction is half the circumference, the present disclosure is not limited to this. In the present disclosure, the length of the third cylinder portion 15 extending along the circumferential direction may be greater than half the circumference, that is the central angle corresponding to the circumferential length of the third cylinder portion 15 may be greater than 180 degrees.
2. Although it has been described in the specific embodiments that the first connection portion 12 and the second connection portion 14 extend along the radial direction R, the present disclosure is not limited to this. The first connection portion 12 and the second connection portion 14 may extend obliquely relative to the radial direction R.
3. Although not described in the above specific embodiments, the camshaft phaser according to the present disclosure may be provided with an outer cover the same as the outer cover 60 of the camshaft phaser in the prior art.
4. In addition, the insertion piece for the camshaft phaser and the camshaft phaser according to the present disclosure may have the following advantages.

The insertion piece 1 for the camshaft phaser is an integral piece and is preferably formed by one-time processing, so the coaxial tolerance of the cylinder portions of the insertion piece 1 is very small, thereby facilitating assembling of the central valve 6.

Figure 1A:
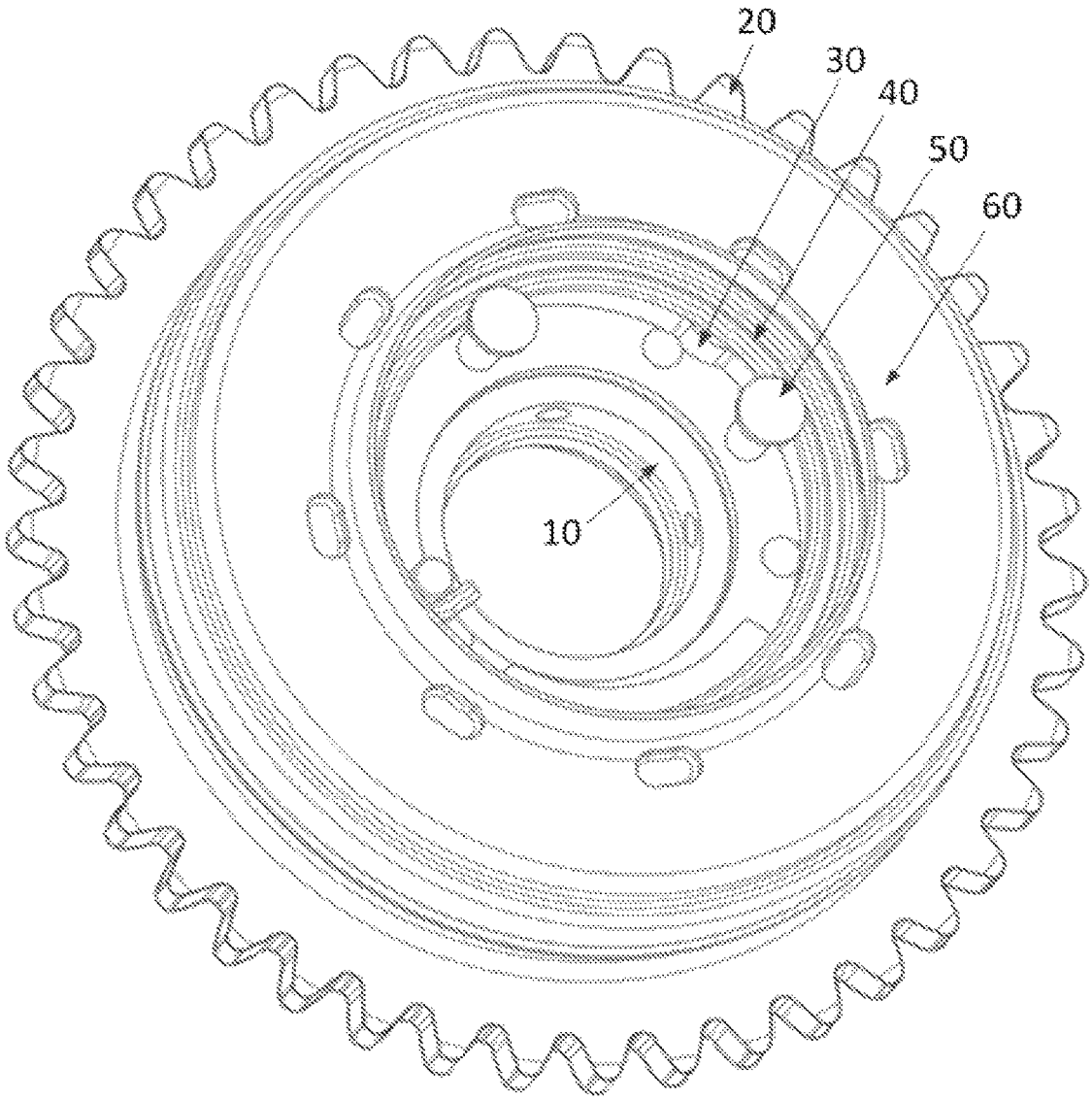
FIG. 1a (PRIOR ART)
FIG. 1*a* is a three-dimensional structural schematic diagram of a camshaft phaser of the prior art.
Figure 1B:
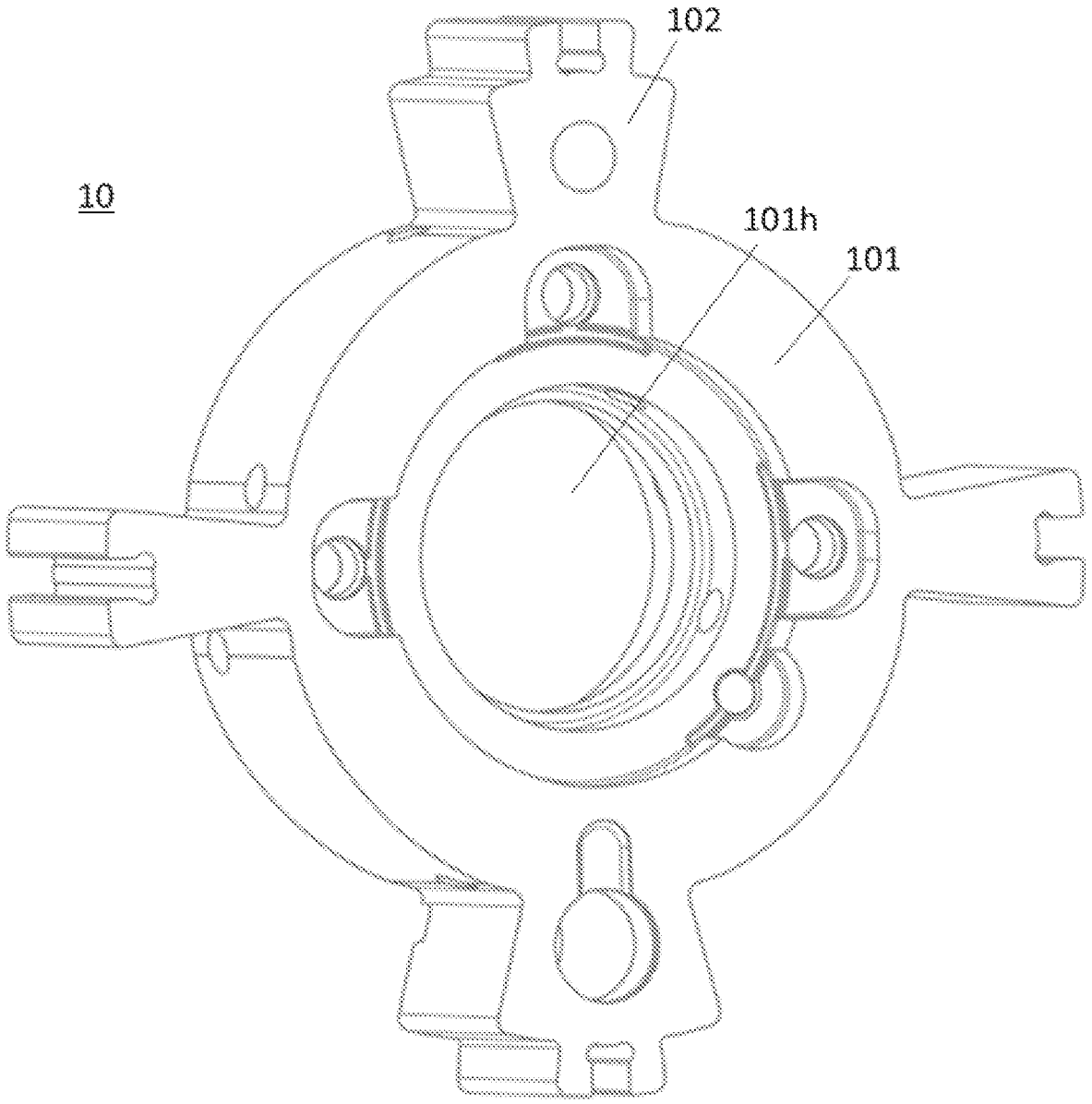
FIG. 1b (PRIOR ART)
FIG. 1*b* is a three-dimensional structural schematic diagram of a rotor of a camshaft phaser in FIG. 1*a*.
Figure 1C:
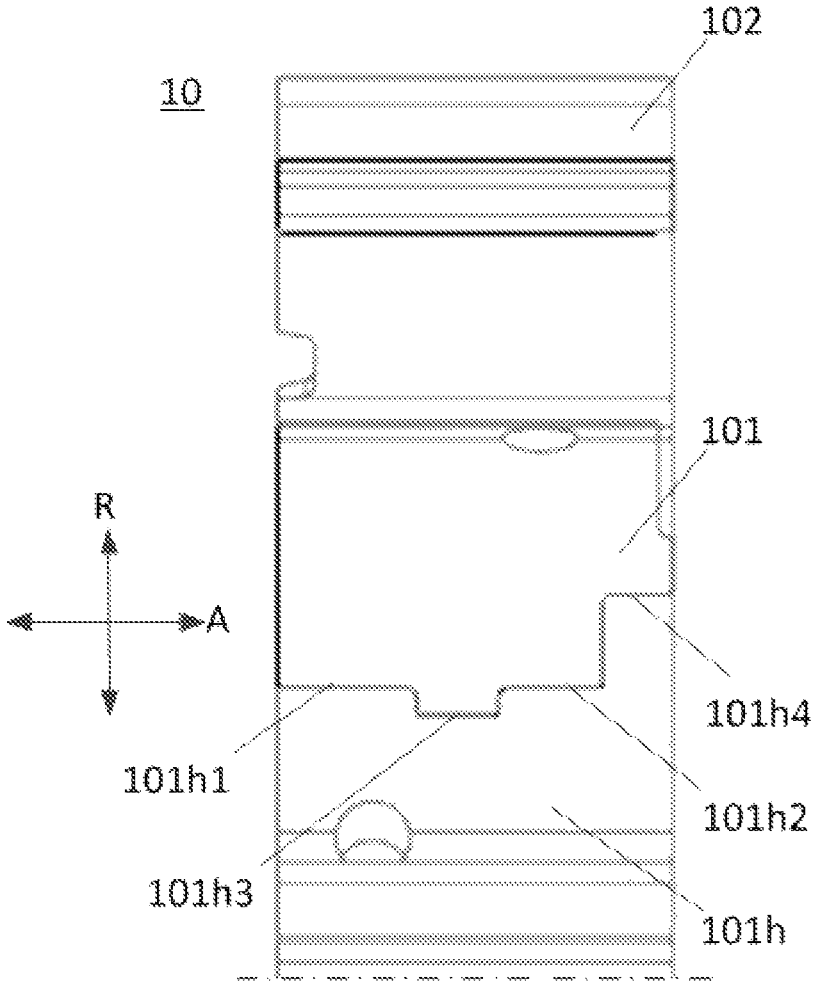
FIG. 1c (PRIOR ART)
FIG. 1*c* is a section schematic diagram of the localized structure cross-section along an axial direction of the rotor in FIG. 1*b;*

The insertion piece 1 for the camshaft phaser according to the present disclosure replaces the fixing pin 50 of the camshaft phaser in the prior art in FIG. 1*a*, so space is saved and cost is reduced. In addition, the rotor does not need to form a fixing pin mounting hole for mounting the fixing pin 50, so that cost is reduced.

By adoption of the insertion piece 1 for the camshaft phaser according to the present disclosure, the rotor 2 may have a smaller axial width, so the axial width of the whole camshaft phaser can be reduced and the weight is correspondingly reduced.

LIST OF REFERENCE SYMBOLS

10 Rotor
101 Rotor body
101*h* Center hole
101*h*1 First hole wall portion
101*h*2 Second hole wall portion
101*h*3 Third hole wall portion
101*h*4 Fourth hole wall portion
102 Rotor blade
20 End cover
30 Spring cover
40 Coil spring
50 Fixing pin
60 Outer cover
1 Insertion piece for camshaft phaser (insertion piece)
11 First cylinder portion
12 First connection portion
13 Second cylinder portion
13*h* Through holes
14 Second connection portion
15 Third cylinder portion
151 Gap
152 Hook portion
2 Rotor
2*h* Center hole
3 End cover
4 Spring cover
5 Coil spring
6 Central valve
61 Central valve cylinder portion
61*h*1 Flange portion
61*h*1 Central valve first through hole
61*h*2 Central valve second through hole
A Axial direction
R Radial direction

The invention claimed is:

1. An insertion piece for a center hole of a rotor of a camshaft phaser, the insertion piece comprising:

a first cylinder portion, a second cylinder portion connected to the first cylinder portion, and a third cylinder portion connected to the second cylinder portion, the third cylinder portion including a clamping connection portion configured to fix a coil spring to the rotor, wherein the first, second, and third cylinder portions are coaxially arranged in a stepped cylindrical shape, and wherein an outer diameter of the first cylinder portion is less than an outer diameter of the second cylinder portion, and the outer diameter of the second cylinder portion is less than an outer diameter of the third cylinder portion.

2. The insertion piece of claim 1, further comprising:

a connection portion configured to connect the second cylinder portion to the third cylinder portion, the connection portion: i) extending radially outward from an axial end of the second cylinder portion, and ii) configured to abut with a flange portion of a central valve.

3. The insertion piece of claim 1, wherein the third cylinder portion extends circumferentially so as to form a partial circumference, and the clamping connection portion is formed on a circumferential end part of the partial circumference.

4. The insertion piece of claim 3, wherein the clamping connection portion includes a gap formed on the circumferential end part, the gap configured to receive an end of the coil spring.

5. The insertion piece of claim 4, wherein the gap is formed by a hook portion of the third cylinder portion, the hook portion pulled toward an inner radial side of the third cylinder portion.

6. The insertion piece of claim 1, wherein the second cylinder portion further comprises a plurality of through-holes extending radially and arranged in a circumferential direction.

7. A camshaft phaser comprising:

a stator, and a rotor including a center hole extending axially through the rotor, the rotor arranged on an inner radial side of the stator and configured to rotate relative to the stator, and the insertion piece of claim 1, wherein:

the insertion piece is fixed to the rotor, the first and second cylinder portions are disposed within the center hole, and a second connection portion connecting the second cylinder portion to the third cylinder portion, the second connection portion abutting against an axial end of the rotor.

8. The camshaft phaser of claim 7, wherein the outer diameter of the second cylinder portion is greater than a diameter of the center hole such that the second cylinder portion is mounted in the center hole via an interference fit with the rotor.

9. The camshaft phaser of claim 7, further comprising a central valve disposed within the center hole, the central valve including an axially extending central valve cylinder portion and a radially extending flange portion, wherein the central valve cylinder portion is disposed within the first cylinder portion via a clearance fit, and the flange portion abuts against an axial side of the second connection portion so as to fix the insertion piece to the rotor.

10. The camshaft phaser of claim 7, further comprising a spring cover fixed on an axial end of the stator so as to cover the coil spring, wherein the third cylinder portion is arranged on an inner radial side of the spring cover.

11. The camshaft phaser of claim 7, further comprising a central valve disposed within the center hole, and a first oil path and a second oil path are formed radially between the central valve and a radial inner surface of the center hole, the first and second oil paths separated by a first connection portion configured to connect the first cylinder portion to second cylinder portions.

12. A camshaft phaser comprising:

a stator, a rotor configured to rotate relative to the stator, the rotor including a center hole extending axially through the rotor, a central valve at least partially disposed within the center hole, and an insertion piece fixed to the rotor via the central valve, the insertion piece including:

a first cylinder portion sealingly engaging an outer diameter of the central valve;

a second cylinder portion:

sealingly engaging a radial inner surface of the center hole, and forming a clearance fit with the outer diameter of the central valve, and a third cylinder portion having a clamping connection portion fixed to a coil spring, and the first, second, and third cylinder portions formed from one piece.

13. The camshaft phaser of claim 12, further comprising a first connection portion configured to connect the first cylinder portion to the second cylinder portions, the first connection portion defining at least a portion of both-a first oil path and a second oil path.

14. The camshaft phaser of claim 13, further comprising a second connection portion configured to connect the second cylinder portion to the third cylinder portion, the second connection portion fixed to an axial end of the rotor via the central valve.

15. The camshaft phaser of claim 14, wherein the first and second connection portions each extend radially.

16. The camshaft phaser of claim 14, wherein the second connection portion includes a plurality of through-holes configured to fluidly connect the central valve to the rotor.

17. The camshaft phaser of claim 12, wherein the third cylinder portion extends circumferentially so as to form a partial circumference, and the clamping connection portion is formed on a circumferential end part of the partial circumference.

18. The camshaft phaser of claim 17, wherein the clamping connection portion includes a gap formed on the circumferential end part, the gap configured to receive an end of the coil spring.

19. The camshaft phaser of claim 18, wherein the gap is configured to axially fix the end of the coil spring to the circumferential end part.

20. The camshaft phaser of claim 1, further comprising a spring cover, wherein the third cylinder portion extends through the spring cover.

* * * * *